US005619899A

United States Patent [19]

Asai et al.

[11] Patent Number: 5,619,899

[45] Date of Patent: Apr. 15, 1997

[54] RODLESS CYLINDER

[75] Inventors: Go Asai; Kazuhiro Iida; Michikazu Miyamoto, all of Ibaraki-ken, Japan

[73] Assignee: SMC Kabushiki Kaisha, Tokyo, Japan

[21] Appl. No.: 554,404

[22] Filed: Nov. 6, 1995

[30] Foreign Application Priority Data

Nov. 14, 1994 [JP] Japan ..... 6-279057

[51] Int. Cl.[6] ..... F01B 29/00

[52] U.S. Cl. ..... 92/88; 92/137

[58] Field of Search ..... 92/88, 137; 277/DIG. 7

[56] References Cited

U.S. PATENT DOCUMENTS 5,111,913 5/1992 Granbom ..... 92/88 X

FOREIGN PATENT DOCUMENTS 0602417 6/1994 European Pat. Off. ..... 92/88
3176804 7/1988 Japan ..... 92/88
3190907 8/1988 Japan ..... 92/88
452482 12/1992 Japan .

*Primary Examiner*—Hoang Nguyen
*Attorney, Agent, or Firm*—Oblon, Spivak, McClelland, Maier & Neustadt, P.C.

[57] ABSTRACT

A rodless cylinder has a linear guide which primarily bears loads $F_1$, $F_2$, $F_3$ applied to a slide table and a table guide which secondarily bears those loads $F_1$, $F_2$, $F_3$. The table guide has a centering function performed by being displaced a small distance in a direction substantially perpendicular to the axis thereof when a load is applied to the slide table.

17 Claims, 9 Drawing Sheets

RODLESS CYLINDER

BACKGROUND OF THE INVENTION

1. Field of the Invention

The present invention relates to a rodless cylinder having a pair of guides for bearing a load imposed on a slide table.

2. Description of the Related Art

Rodless cylinders have recently been finding wide use as workpiece feed mechanisms in factories or the like. Rodless cylinders take up a smaller installation space and can be handled more easily than ordinary cylinders with rods because the rodless cylinders have a shorter stroke of displacement. In addition, the rodless cylinders are capable of preventing dirt, dust, and other foreign matter from entering the cylinder tube more effectively than the ordinary cylinders with rods, with the result that the rodless cylinders can perform highly accurate positioning operation on workpieces which are fed by the rodless cylinders.

One typical rodless cylinder comprises a cylinder tube and a slide table which is linearly movable reciprocally under the pressure of compressed air supplied through a port. A guide is disposed between the slide table and the cylinder tube for allowing the slide table to slide smoothly with respect to the cylinder tube.

One conventional form of guide comprises a guide rail mounted on one side wall of the cylinder tube which is displaced sideways off the longitudinal axis of the cylinder tube (see Japanese utility model publication No. 4-52482).

However, the side rail mounted on one side wall of the cylinder tube as disclosed in Japanese utility model publication No. 4-52482 poses certain problems. For example, the guide rail tends to undergo an excessive load due to a load that is applied at a position spaced from the longitudinal axis of the cylinder tube by a workpiece or the like supported on the slide table or a load that is generated by a shock caused at an end of the stroke of the slide table. As a result, the durability of the guide table is relatively low, making it difficult to maintain the linearity of movement of the slide table for a long period of time.

One solution would be to use a pair of spaced linear guides of identical structure disposed between the slide table and the cylinder tube and positioned on respective opposite side walls of the cylinder tube. However, the identical linear guides are liable to interfere operatively with each other owing to manufacturing errors thereof or loads applied to the slide table. As a consequence, the linear guides soon suffer play developed in use, failing to allow the slide table to be displaced smoothly with respect to the cylinder tube in an initially intended fashion.

SUMMARY OF THE INVENTION

It is a general object of the present invention to provide a rodless cylinder which has a pair of guides that are prevented from operative interference with each other and that allow a slide table to be displaced smoothly with respect to a cylinder tube even when loads are applied to the slide table in a direction substantially parallel or perpendicular to the axis of the slide table.

A main object of the present invention is to provide a rodless cylinder which has first and second guides for bearing their allotted shares of loads acting on a slide table, one of the first and second guides having a centering function performed by being displaced a small distance in a direction substantially perpendicular to the axis thereof when a load is applied to the slide table, for thereby preventing load bearing functions of the first and second guides from operatively interfering with each other.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
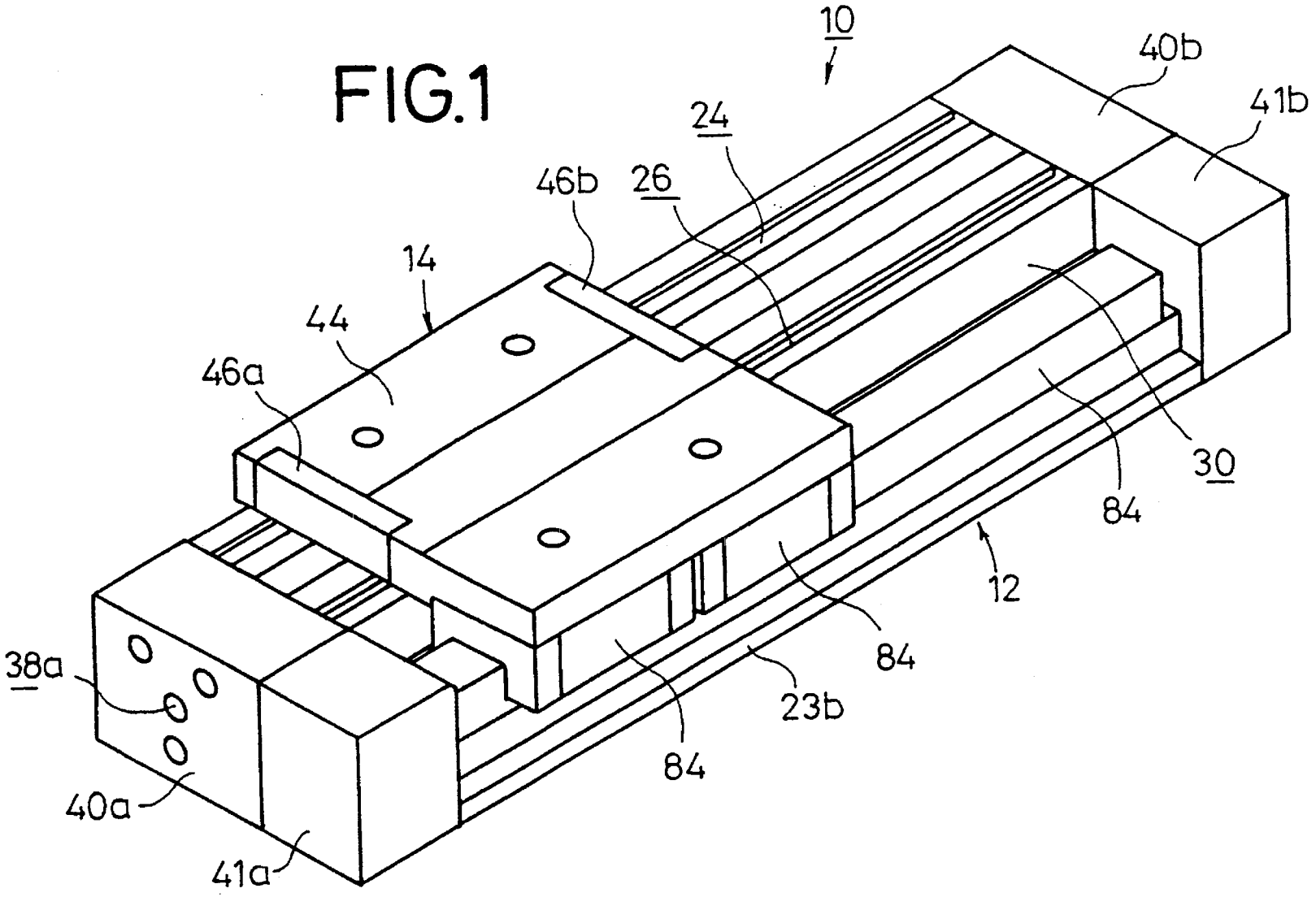
FIG. 1 is a perspective view of a rodless cylinder according to the present invention.

As shown in FIG. 1, a rodless cylinder, generally designated by reference numeral 10, according to the present invention comprises a cylinder tube 12 and a slide table 14 longitudinally movably mounted on the cylinder tube 12. The cylinder tube 12 has a longitudinally extending bore 16 (see FIG. 2) defined therein at a position that is transversely off-center toward one side of the cylinder tube 12. The bore 16 communicates with the exterior space through a longitudinal slit 18 that is defined in an upper end wall of the cylinder tube 12. The cylinder tube 12 has a longitudinally extending sensor attachment groove 20 defined in a side wall thereof, and a pair of longitudinally extending holes or passages 22 defined therein for accommodating a wiring harness. The cylinder tube 12 also has a pair of longitudinally extending ridges 23*a*, 23*b* projecting outwardly from the respective lower edges of opposite side walls thereof. The ridges 23*a*, 23*b* serve to support the rodless cylinder 10 stably on an installation base (not shown).

Figure 2:
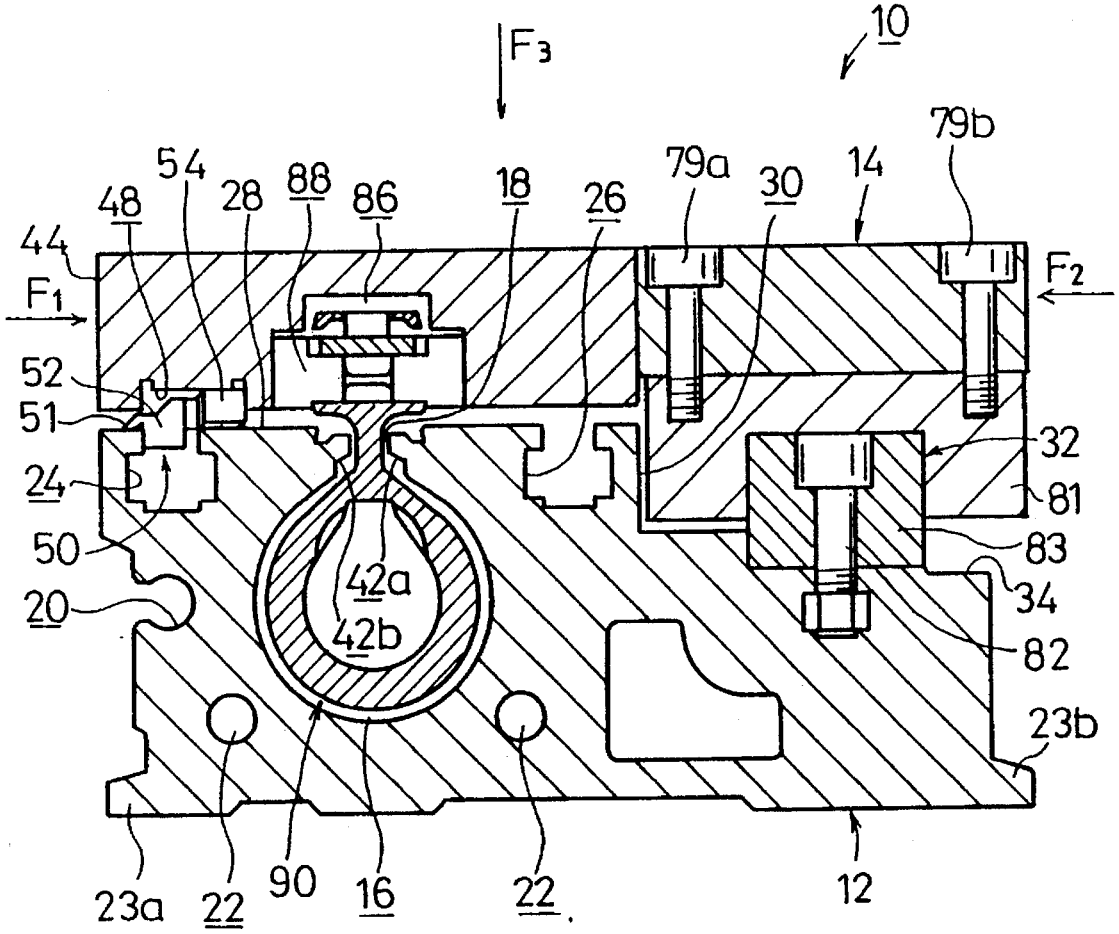
FIG. 2 is a transverse cross-sectional view of a cylinder tube and a slide table of the rodless cylinder shown in FIG. 1.

As shown in FIG. 2, the upper end wall of the cylinder tube 12 is composed of a first upper surface 28 having the slit 18 communicating with the bore 16, and a pair of grooves 24, 26 each of a substantially T-shaped cross section which are defined one on each side of the slit 18 and extending longitudinally of the cylinder tube 12, and a second upper surface 34 lying laterally of and lower than the first upper surface 28 with a vertical step 30 disposed therebetween, the second upper surface 34 supporting a linear guide 32 thereon which is interposed between the slide table 14 and the second upper surface 34. As shown in FIG. 1, the cylinder tube 12 has its axially opposite ends hermetically closed by a pair of respective end caps 40*a*, 40*b* and a pair of respective end blocks 41*a*, 41*b*, each in the form of a rectangular parallelepiped. The end caps 40*a*, 40*b* have respective ports 38*a*, 38*b* defined therein (the port 38*b* not shown). The upper end wall of the cylinder tube 12 in which the slit 18 is defined has a pair of laterally spaced steps 42*a*, 42*b* (see FIGS. 2 and 10) that are spread progressively outwardly away from each other in a direction toward the bore 16.

The slide table 14 will be described below.. As shown in FIG. 1, the slide table 14 comprises a plate 44 substantially in the form of a rectangular parallelepiped having substantially the same width as the transverse width of the cylinder tube 12, and a pair of cover plates 46*a*, 46*b* fixed respectively to longitudinal ends of the plate 44.

Figure 3:
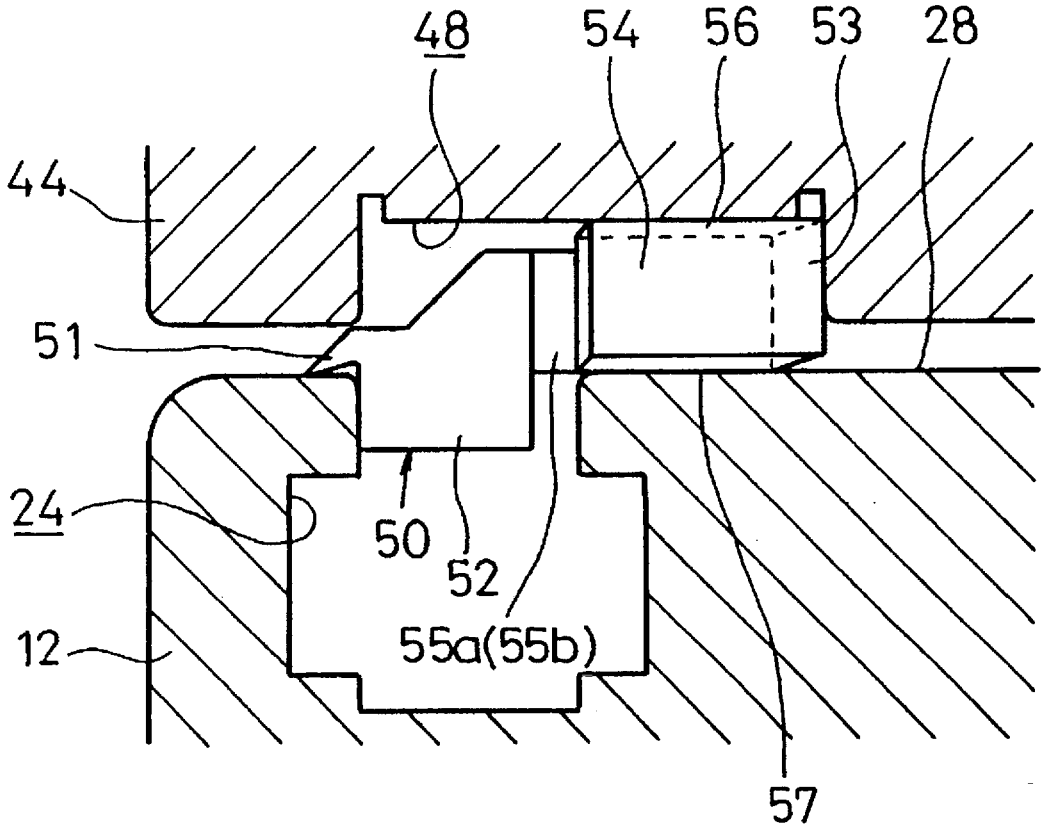
FIG. 3 is an enlarged fragmentary transverse cross-sectional view of a guide in the rodless cylinder shown in FIG. 2.

As shown in FIGS. 2 and 3, the slide table 14 has a longitudinally extending recess 48 of a substantially rectangular cross section defined in a lower surface thereof and opening downwardly in substantial alignment with the groove 24 defined in the first upper surface 28 of the cylinder tube 12. In the recess 48, there is mounted a table guide 50 made of a resilient material such as rubber, synthetic resin, elastomer, or the like. The table guide 50 has a centering function capable of being displaced a small distance in a direction substantially perpendicular to the axis thereof when a load is applied to the slide table 14, for thereby allowing the linear guide 32 and the table guide 50 to perform a smooth load bearing function while preventing themselves from operatively interfering with each other.

Figure 4:
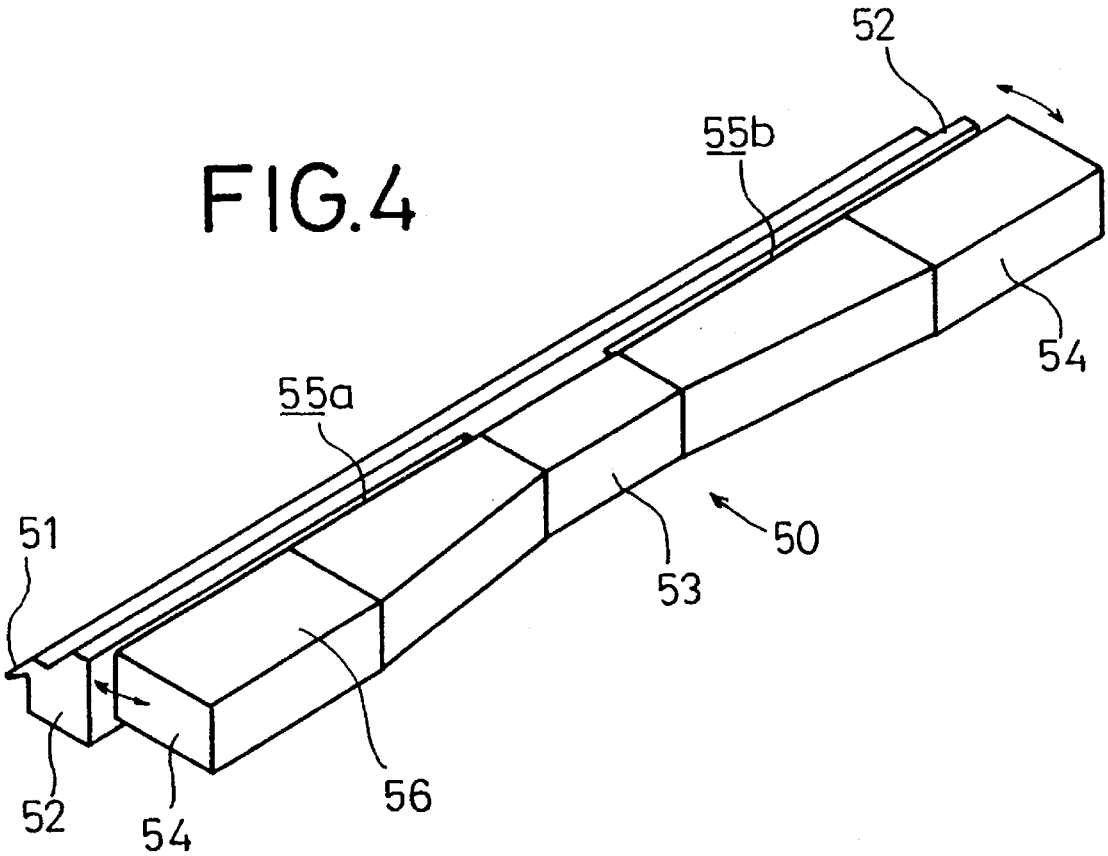
FIG. 4 is a perspective view of the guide shown in FIG. 3.

The table guide 50 extends in the longitudinal direction of the cylinder tube 12, and comprises, as shown in FIGS. 3 and 4, a slider 52 having a tongue 51 for preventing dirt, dust, or other foreign matter from entering the groove 24 and the recess 48 and other regions between the cylinder tube 12 and the slide table 14, and a support 54 integrally formed with the slider 52 and extending along a longitudinal edge thereof. The slider 52 is positioned in the groove 24, and the support 54 is positioned in the recess 48 and disposed on the first upper surface 28 of the cylinder tube 12. The support 54 has a side wall surface 53 facing remotely from the slider 52 and gradually curved concavely from its longitudinal opposite ends toward its longitudinal center. The table guide 50 also has a pair of longitudinally spaced slits 55*a*, 55*b* defined between the slider 52 and the support 54. The support 54 has an upper surface 56 which faces the bottom of the recess 48 and is progressively concave from its longitudinal opposite ends toward its longitudinal center, and a lower surface 57 which is held against the first upper surface 28 of the cylinder tube 12 and progressively slanted a given angle from a flat longitudinally central portion thereof toward its longitudinal opposite ends.

When a substantially horizontal load $F_1$ or $F_2$ (see FIG. 2) is applied to the slide table 14, the support 54 is slightly elastically deformed in directions perpendicular to the axis thereof as indicated by the arrows in FIG. 4 due to the slits 55*a*, 55*b* and the curved side wall surface 53, so that the slide table 14 can be displaced a small distance in those directions for thereby bearing the applied horizontal load $F_1$ or $F_2$. When a substantially vertically downward load $F_3$ is applied to the slide table 14, the support 54 is also slightly elastically deformed downwardly due to the curved or slanted upper and lower surfaces 56, 57, so that the slide table 14 can be displaced a small distance downwardly for thereby bearing the applied load $F_3$.

The table guide 50 is retained by the recess 48 in the slide table 14 for displacement with the slide table 14 in the longitudinal direction of the cylinder tube 12. The table guide 50 is slidable along the groove 24 in the cylinder tube 12 for guiding the slide table 14 linearly along the groove 24.

The through third modifications of the table guide 50 will be described below with reference to FIGS. 5A and 5B, 6, and 7, respectively. Those parts of the table guides according to the first through third modifications which are identical to each other are denoted by identical reference characters, and will not be described in detail below.

Figure 5A:
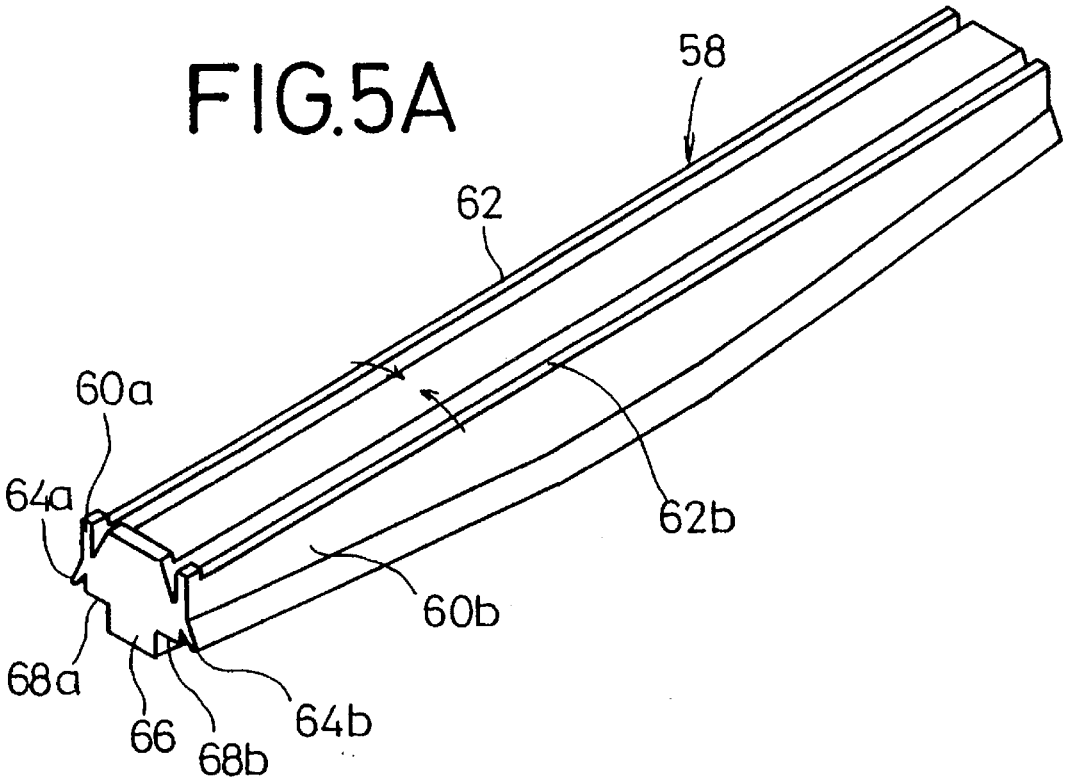
FIG. 5A is a perspective view of a guide according to a first modification.
Figure 5B:
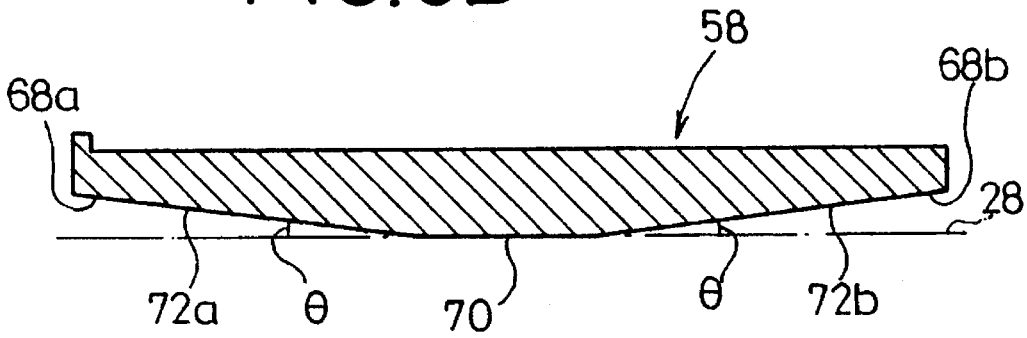
FIG. 5B is a longitudinal cross-sectional view of the guide shown in FIG. 5B.

FIGS. 5A and 5B show a table guide 58 according to the first modification. The table guide 58 has a pair of opposite resilient lips 60*a*, 60*b* extending longitudinally and integrally formed therewith. The lips 60*a*, 60*b* have respective upper portions 62*a*, 62*b* which are slightly thicker than the remainder thereof. The upper portions 62*a*, 62*b* can be flexed inwardly toward each other as indicated by the arrows under a load $F_1$ or $F_2$ applied horizontally to the slide table 14, making the table guide 58 flexible to a certain degree of freedom in the horizontal direction. The lips 60*a*, 60*b* also have respective lower skirts 64*a*, 64*b* spreading outwardly away from each other in the downward direction for sliding contact with the first upper surface 28 of the cylinder tube 12 for thereby preventing dirt, dust, or other foreign matter from entering the groove 24 in the cylinder tube 12 and the recess 48 in the slide table 14, and other regions between the cylinder tube 12 and the slide table 14.

The table guide 58 further includes a longitudinally extending ridge 66 of substantially rectangular cross-section integrally formed with a lower surface thereof. The ridge 66 is positioned in and slidable along the groove 24 in the first upper surface 28 of the cylinder tube 12.

The lower surface of the table guide 58 includes a pair of laterally spaced lower surface areas 68*a*, 68*b* which are longitudinally curved and held in contact with the first upper surface 28. Specifically, as shown in FIG. 5B, each of the lower surface areas 68*a*, 68*b* comprises a flat longitudinally central portion 70 which is held in contact with the first upper surface 28 under normal conditions with no load imposed on the slide table 14, and a pair of curved or slanted portions 72*a*, 72*b* disposed adjacent to and one on each side of the central portion 70 and slanted upwardly in directions away from the central portion 70 at a given angle θ (e.g., θ=1°~10°). When the slide table 14 reaches an end of its stroke with respect to the cylinder tube 12, the slanted portions 72*a*, 72*b* are forced into contact with the first upper surface 28, resulting in an increased area of contact with the first upper surface 28. Therefore, the slanted portions 72*a*, 72*b* are capable of bearing loads generated on the slide table 14 in the axial direction at and end of the stroke thereof.

Figure 6:
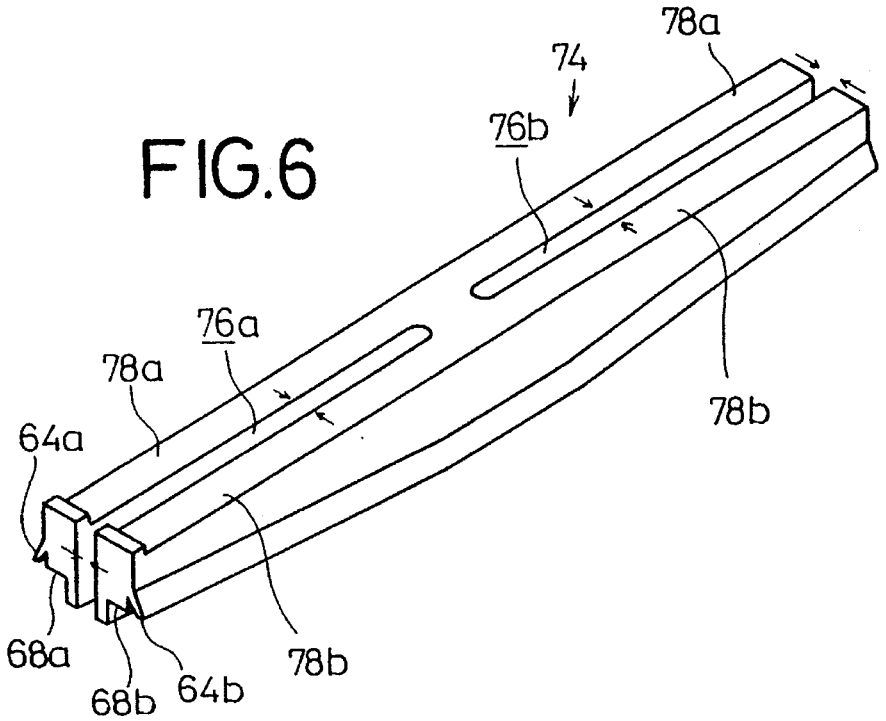
FIG. 6 is a perspective view of a guide according to a second modification.

FIG. 6 shows a table guide 74 according to the second modification. The table guide 74 has a pair of longitudinally spaced grooves 76*a*, 76*b* defined therein in the longitudinal direction thereof. Each of the grooves 76*a*, 76*b* extends vertically through the table guide 74 from the upper to lower surface thereof. The table guide 74 has a pair of laterally spaced symmetrical guide members 78*a*, 78*b* branched or spaced by the grooves 76*a*, 76*b*. Since one of the guide members 78*a*, 78*b* can be resiliently flexed toward the other in the transverse direction of the table guide 74, the table guide 74 is flexible to a certain degree of freedom in the horizontal direction. The table guide 74 has a pair of curved lower surface areas 68*a*, 68*b* each composed of a flat central portion 70 and a pair of slanted portions 72*a*, 72*b* as with the table guide 58 shown in FIG. 5B.

Figure 7:
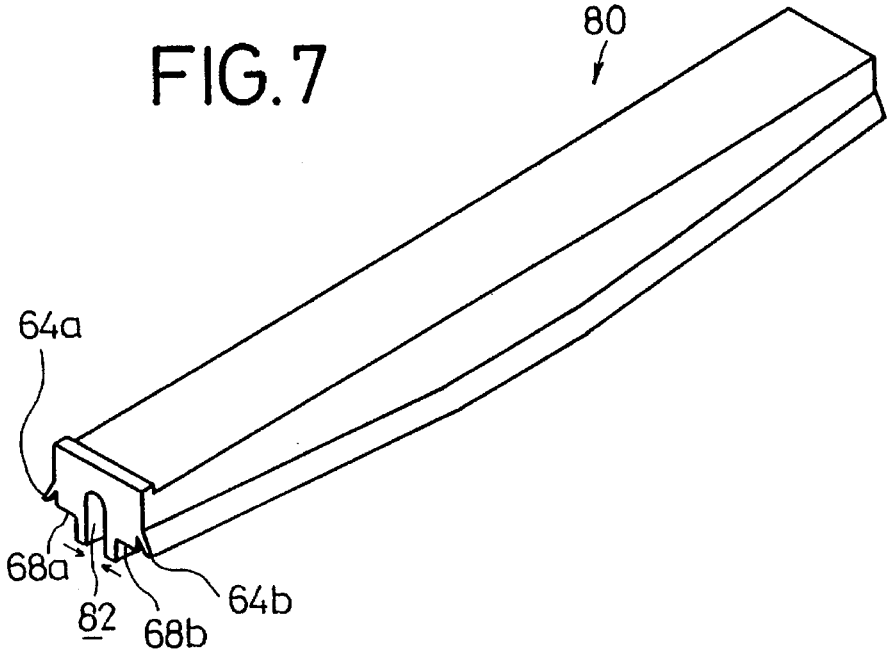
FIG. 7 is a perspective view of a guide according to a third modification.

FIG. 7 shows a table guide 80 according to the third modification. The table guide 80 has a groove 82 of inverted U-shaped cross section defined in a lower surface thereof in the longitudinal direction thereof. The groove 82 extends upwardly from the lower surface of the table guide 80, but terminates short of the upper surface thereof. The groove 82 allows the table guide 80 to be flexible with a certain degree of freedom in the horizontal direction. The table guide 80 has a pair of curved lower surface areas 68*a*, 68*b* each composed of a flat central portion 70 and a pair of slanted portions 72*a*, 72*b* as with the table guide 58 shown in FIG. 5B.

As shown in FIG. 2, the linear guide 32 is disposed between the second upper surface 34 of the cylinder tube 12 and the slide table 14. The linear guide 32 comprises a guide block 81 of substantially channel-shaped cross section which is fixed to a lower surface of the slide table 14 by screws 79*a*, 79*b*, and a guide rail 84 fixed to the second upper surface 34 by a screw 83. The guide block 81 is slidably fitted over the guide rail 84 by a plurality of balls (not shown) which are rollingly disposed in an annular passage (not shown) that is defined in the guide block 81 and the guide rail 84.

The slide table 14 has a longitudinally extending groove 86 defined centrally through the plate 44 and including a horizontally circular central space 88 opening downwardly. The groove 86 has a bottom surface curved upwardly toward the upper surface of the plate 44.

Figure 8:
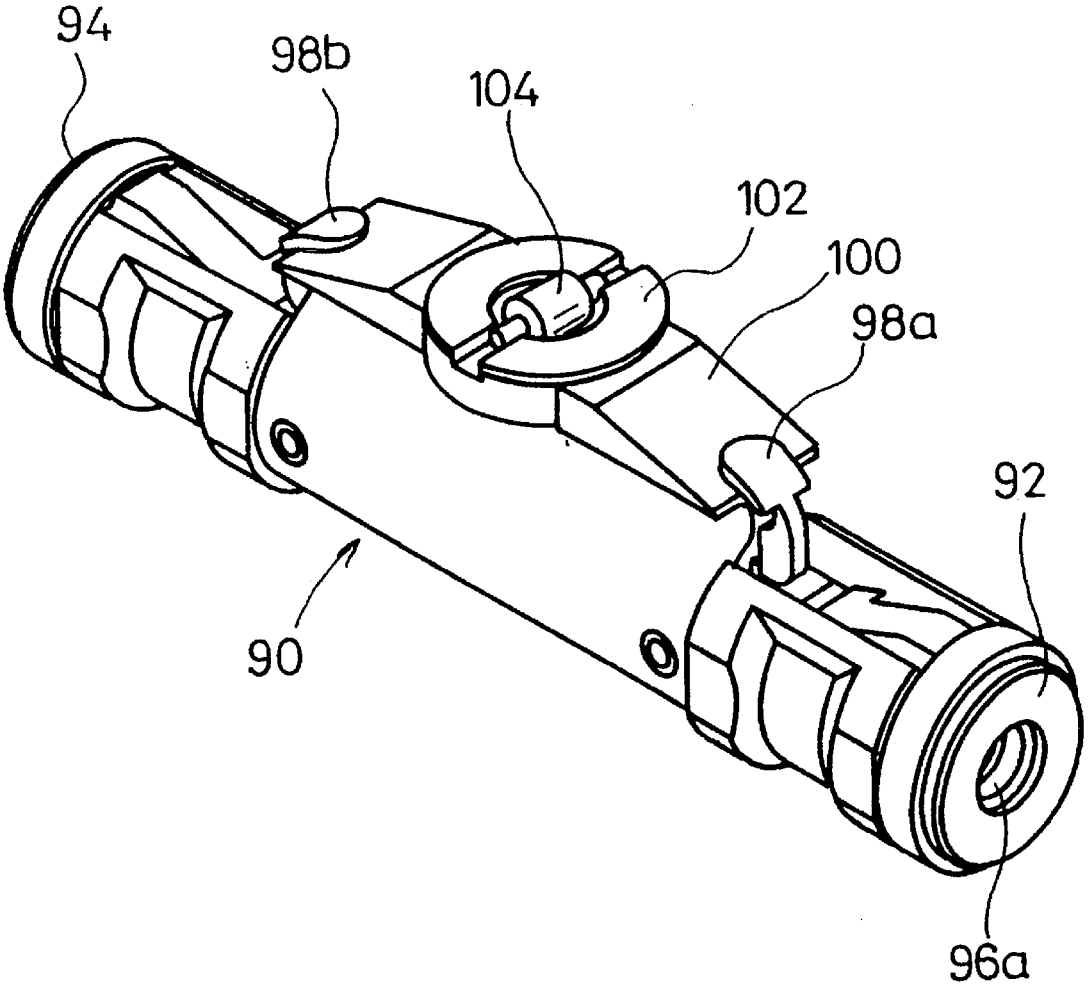
FIG. 8 is a perspective view of a piston of the rodless cylinder shown in FIG. 1.
Figure 9:
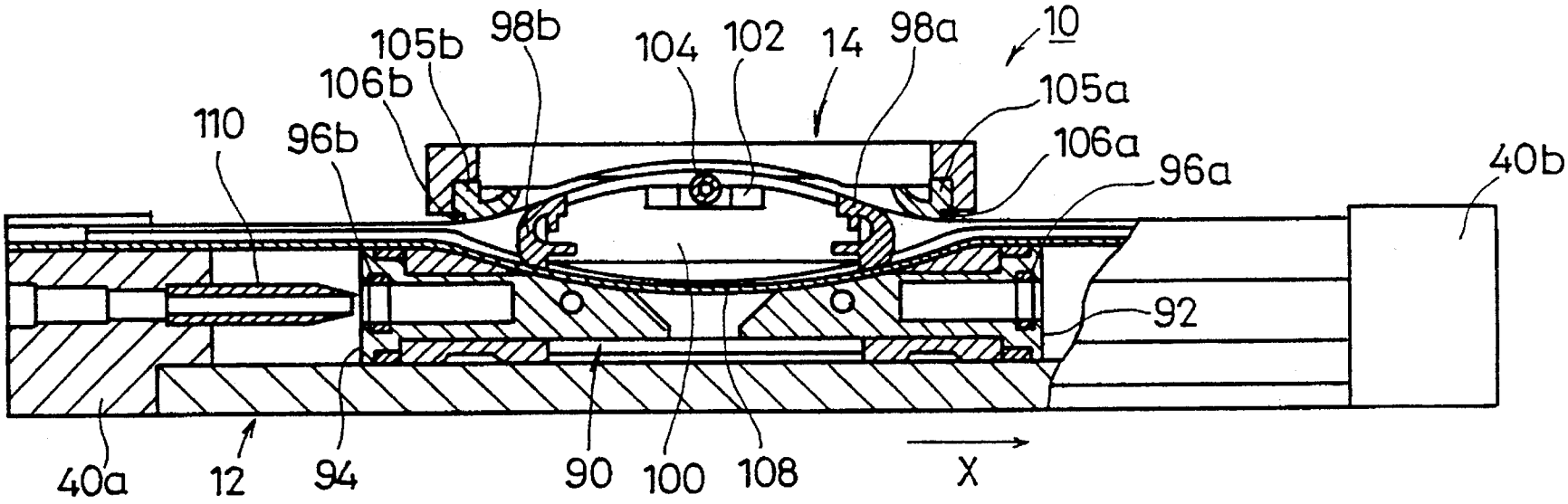
FIG. 9 is a fragmentary longitudinal cross-sectional view of the rodless cylinder shown in FIG. 1.

FIG. 8 shows a piston 90 which is axially movably disposed in the bore 16 in the cylinder tube 12. The piston 90 which is of a cylindrical shape has a first pressure-bearing surface 92 on its one axial end and a second pressure-bearing surface 94 on its other axial end, with cushion seals 96*a*, 96*b* (see also FIG. 9) disposed respectively in the first and second pressure-bearing surfaces 92, 94. The piston 9 also has a pair of belt separators 98*a*, 98*b* fixed to respective ends of a piston yoke 100 on an upper surface thereof, and a roller 104 rotatably mounted on an upper surface of the piston yoke 100 by a coupler 102 which is fitted in the circular space 88. As shown in FIG. 9, the cover plates 46*a*, 46*b* support respective backup plate 105*a*, 105*b* on their inner surfaces, and the backup plates 105*a*, 105*b* supports respective scrapers 106*a*, 106*b* thereon. The piston 90 also has a passage 108 for allowing a first seal member 112 (described below) to enter therethrough into the piston 90. The cylinder tube 12 has a pair of cushion rings 110 (one shown in FIG. 9) supported by the respective end caps 40*a*, 40*b* for engaging the respective cushion seals 96*a*, 96*b* when the piston 90 moves axially in the piston 90.

Figure 10:
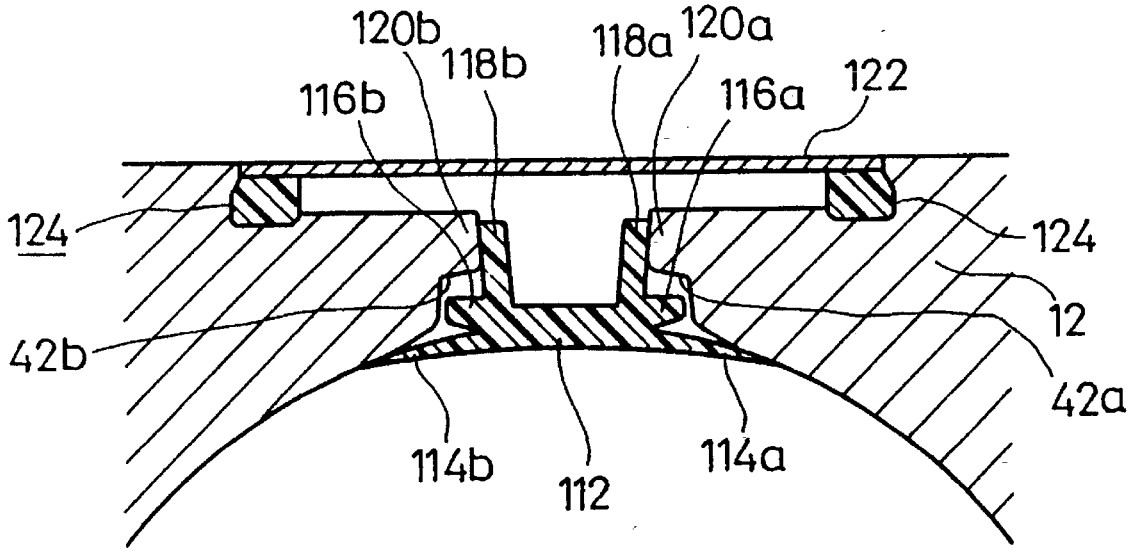
FIG. 10 is an enlarged fragmentary transverse cross-sectional view showing a first seal member engaging in a slit in the rodless cylinder shown in FIG. 1.

The first seal member 112 as it is fitted in the steps 42*a*, 42*b* is shown in FIG. 10. The first seal member 112 has a pair of laterally spaced tongues 114*a*, 114*b* extending transversely away from each other on its lower end and a pair of laterally spaced ledges 116*a*, 116*b* extending transversely away from each other at a position above the respective tongues 114*a*, 114*b*. The first seal member 112 also includes a pair of laterally spaced engaging arms 118*a*, 118*b* extending upwardly respectively from the ledges 116*a*, 116*b* in a slightly spreading pattern. The ledges 116*a*, 116*b* engage the steps 42*a*, 42*b*, respectively, when an internal pressure is developed in the piston 90 and acts on the first seal member 112. The engaging arms 118*a*, 118*b* engage respective inner surfaces 120*a*, 120*b* of the cylinder tube 12 which define the slit 18 therebetween. The first seal member 112 enters into the piston 90 through the passage 108 thereof. The first seal member 112 is integrally molded of flexible synthetic resin as a whole.

FIG. 10 also shows a second seal member 122 which is mounted on the cylinder tube 12 in covering relation to the slit 18. The second seal member 122 has its longitudinal opposite edges engaging in respective slots 124 which are defined in the first upper surface 28 of the cylinder tube 12 above the slit 18 and extend in the longitudinal direction of the cylinder tube 12. The first seal member 12 and the second seal member 122 have opposite ends fastened to the end caps 40*a*, 40*b*.

Operation of the rodless cylinder 10 of the above structure will be described below.

After the rodless cylinder 10 is assembled as shown in FIG. 1, compressed air is introduced into the rodless cylinder 10 through the port 38*a*. The introduced compressed air flows through a passage defined in the cushion ring 110 connected to the port 38a and acts on the first pressure-bearing surface 94 of the piston 90, thereby displacing the piston 90 to the right, i.e., in the direction indicated by the arrow X (see FIG. 9). Since the coupler 102 is fitted in the circular space 88 in the slide table 14, the slide table 14 is also displaced to the right, i.e., in the direction indicated by the arrow X, by the piston 90. At this time, the belt separators 98*a*, 98*b* separate the first seal member 112 and the second seal member 122 vertically from each other between the slide table 14 and the piston 90. A workpiece (not shown) which is mounted on the slide table 14 is therefore displaced to the right in FIG. 9.

When the piston 90 is displaced in the direction indicated by the arrow X, the slide table 14 is supported by the table guide 50 and the linear guide 32. The slider 52 of the table guide 50 slides along the groove 24, and the support 54 thereof slides along the first upper surface 28 of the cylinder tube 12. The guide block 81 of the linear guide 32 slides along the guide rails 82 through the non-illustrated balls. Therefore, the slide table 14 is smoothly displaced in the longitudinal direction of the cylinder tube 12 by the table guide 50 and the linear guide 32.

When compressed air is introduced into the port defined in the end cap 40*b*, the slide table 14 is displaced along the cylinder tube 12 in the direction opposite to the direction indicated by the arrow X.

While the slide table 14 is being thus displaced along the cylinder tube 12 in either direction, the roller 104 is held in rolling contact with a lower surface of the second seal member 122 for allowing the piston 90 to move smoothly with respect to the second seal member 122.

Functions of the rodless cylinder 10 to bear loads applied to the slide table 14 will be described in detail below.

It is assumed that a load $F_1$ or $F_2$ is applied substantially horizontally to the slide table 14 (see FIG. 2). The load $F_1$ or $F_2$ which is applied substantially horizontally to the slide table 14 is borne primarily by the linear guide 32 and secondarily by the table guide 50.

At this time, the support 54 of the table guide 50 is flexed inwardly as indicated by the arrows (see FIG. 4) due to the slits 55*a*, 55*b* under the pressure imposed by the horizontal load $F_1$ or $F_2$ applied to the slide table 14. Therefore, the table guide 50 is displaced a small distance in a direction substantially perpendicular to the axis of the slide table 14, thereby performing a centering function with respect to the slide table 14. The table guide 50 which primarily supports the slide table 14 and the linear guide 32 which mainly supports the slide table 14 are prevented from operatively interfering with each other, and are capable of appropriately bearing the load $F_1$ or $F_2$ applied to the slide table 14.

When a substantially downward load $F_3$ is applied to the slide table 14, it is borne by the gradually curved upper and lower surfaces 56, 57 of the support 54.

When the slide table 14 stops at an end of its stroke with respect to the cylinder tube 12, a load is impressed on the slide table 14 in the direction in which it has moved. Such a load is borne by the slanted portions of the lower surface 47 of the table guide 50. It is therefore possible to control the slide table 14 to be tilted within a predetermined range of angles when the slide table 14 reaches an end of its stroke.

As described above, the table guide 50 which primarily supports the slide table 14 has a centering function for preventing load bearing functions of the table guide 50 and the linear guide 32 from operatively interfering with each other, and is also capable of bearing loads applied substantially horizontally to the slide table 14 and in the direction in which the slide table 14 has moved when the slide table 14 stops at an end of its stroke. As a consequence, the table guide 50 allows the slide table 14 to be displaced smoothly with respect to the cylinder tube 12 regardless of loads applied in various directions to the slide table 14.

Although certain preferred embodiments of the present invention have been shown and described in detail, it should be understood that various changes and modifications may be made therein without departing from the scope of the appended claims.

What is claimed is:

1. A rodless comprising:

a cylinder tube having fluid pressure inlet/outlet ports;

a piston disposed in said cylinder tube and reciprocating therein in response to a fluid under pressure supplied through one of said fluid pressure inlet/outlet ports;

a slide table coupled to said piston and being displaceable in unison with reciprocating of said piston; and a linear guide and a table guide disposed between said cylinder tube and said slide table for bearing allotted shares of loads acting on said slide table, said table guide comprising a guide centering said slide table.

2. A rodless cylinder according to claim 1, wherein said linear guide primarily bears loads applied to said slide table, and said table guide secondarily bears loads applied to said slide table.

3. A rodless cylinder according to claim 1, wherein said table guide has a slider and a support which are integrally formed of a flexible material with slits defined therebetween.

4. A rodless cylinder according to claim 3, wherein said support performs said centering function by being displaced a small distance in directions perpendicular to the axis of the slide table under the loads $F_1$, $F_2$ which are applied substantially horizontally to said slide table.

5. A rodless cylinder according to claim 3 wherein said support has a lower surface comprising a flat central portion and a pair of slanted portions disposed at respective ends of said flat central portion and slanted upwardly at a predetermined angle from said flat central portion, and wherein said support performs said centering function by increasing areas of contact of said slanted portions with an upper surface of said cylinder tube under the load $F_3$ which is applied substantially downwardly to said slide table.

6. A rodless cylinder according to claim 3, wherein said slider has a tongue for preventing foreign matter from entering a region between said cylinder tube and said slide table.

7. A rodless cylinder according to claim 3, wherein said support has a side wall surface gradually curved concavely from opposite ends thereof toward a center thereof.

8. A rodless cylinder according to claim 3, wherein said support has an upper surface which is progressively concave from opposite ends thereof toward a center thereof.

9. A rodless cylinder according to claim 3, wherein said cylinder tube has a groove defined in an upper surface thereof, said slider being slidable in and along said groove.

10. A rodless cylinder according to claim 2, wherein said slide table has a recess defined in a lower surface thereof, said table guide being retained in said recess for displacement in unison with said slide table.

11. A rodless cylinder comprising:

a cylinder tube having fluid pressure inlet/outlet ports;

a piston disposed in said cylinder tube and reciprocating therein in response to a fluid under pressure supplied through one of said fluid pressure inlet/outlet ports;

a slide table coupled to said piston and being displaceable in unison with reciprocating of said piston; and a linear guide and a table guide disposed between said cylinder tube and said slide table and bearing allotted shares of loads acting on said slide table, said table guide comprising a guide centering said slide table, wherein said table guide has a pair of opposite resilient lips extending longitudinally and integrally formed therewith, and wherein said lips perform said centering function by being flexed toward each other under loads which are applied substantially horizontally to said slide table.

12. A rodless cylinder according to claim 11, wherein said lips have respective skirts for preventing foreign matter from entering a region between said cylinder tube and said slide table.

13. A rodless cylinder according to claim 11, wherein said table guide has a pair of lower surface areas each comprising a flat central portion and a pair of slanted portions disposed at respective ends of said flat central portion and slanted upwardly at a predetermined angle from said flat central portion and wherein said table guide performs said centering function by increasing areas of contact of said slanted portions with an upper surface of said cylinder tube under the load $F_3$ which is applied substantially downwardly to said slide table.

14. A rodless cylinder comprising:

a cylinder tube having fluid pressure inlet/outlet ports;

a piston disposed in said cylinder tube and reciprocating therein in response to a fluid under pressure supplied through one of said fluid pressure inlet/outlet ports;

a slide table coupled to said piston and being displaceable in unison with reciprocating of said piston; and a linear guide and a table guide disposed between said cylinder tube and said slide table and bearing allotted shares of loads acting on said slide table, said table guide comprising a guide centering said slide table, wherein said table guide comprises a pair of grooves extending therethrough from an upper surface to a lower surface thereof, and a pair of symmetrical guide members branched by said grooves, and wherein said guide members perform said centering function by being displaced toward each other under the loads which are applied substantially horizontally to said slide table.

15. A rodless cylinder according to claim 14, wherein said table guide has a pair of lower surface areas each comprising a flat central portion and a pair of slanted portions disposed at respective ends of said flat central portion and slanted upwardly at a predetermined angle from said flat central portion, and wherein said table guide performs said centering function by increasing areas of contact of said slanted portions with an upper surface of said cylinder tube under the load $F_3$ which is applied substantially downwardly to said slide table.

16. A rodless cylinder comprising:.

a cylinder tube having fluid pressure inlet/outlet ports;

a piston disposed in said cylinder tube and reciprocating therein in response to a fluid under pressure supplied through one of said fluid pressure inlet/outlet ports;

a slide table coupled to said piston and being displaceable in unison with reciprocating of said piston; and a linear guide and a table guide disposed between said cylinder tube and said slide table and bearing allotted shares of loads acting on said slide table, said table guide comprising a guide centering said slide table, wherein said table guide has a groove of an inverted U-shaped cross section defined in a lower surface thereof in a longitudinal direction thereof.

17. A rodless cylinder according to claim 16, wherein said table guide has a pair of lower surface areas each comprising a flat central portion and a pair of slanted portions disposed at respective ends of said flat central portion and slanted upwardly at a predetermined angle from said flat central portion, and wherein said table guide performs said centering function by increasing areas of contact of said slanted portions with an upper surface of said cylinder tube under the load $F_3$ which is applied substantially downwardly to said slide table.

* * * * *